US011812243B2

(12) United States Patent
Shepstone et al.

(10) Patent No.: US 11,812,243 B2
(45) Date of Patent: Nov. 7, 2023

(54) HEADSET CAPABLE OF COMPENSATING FOR WIND NOISE

(71) Applicant: Bang & Olufsen A/S, Struer (DK)

(72) Inventors: Sven Ewan Shepstone, Struer (DK); Pablo Martinez-Nuevo, Frederiksberg (DK)

(73) Assignee: Bang & Olufsen A/S, Struer (DK)

( * ) Notice: Subject to any disclaimer, the term of this patent is extended or adjusted under 35 U.S.C. 154(b) by 0 days.

(21) Appl. No.: 17/698,016

(22) Filed: Mar. 18, 2022

(65) Prior Publication Data

US 2022/0303687 A1 Sep. 22, 2022

(51) Int. Cl.

| | |
|---|---|
| ***H04R 5/033*** | (2006.01) |
| ***H04R 1/02*** | (2006.01) |
| ***H04R 3/04*** | (2006.01) |
| ***H04R 5/04*** | (2006.01) |

(52) U.S. Cl.

CPC ..... *H04R 5/033* (2013.01); *H04R 1/028* (2013.01); *H04R 3/04* (2013.01); *H04R 5/04* (2013.01); *H04R 2410/07* (2013.01)

(58) Field of Classification Search

CPC ..... H04R 5/033; H04R 1/028; H04R 3/04; H04R 5/04; H04R 2410/07; H04S 7/304

USPC ..... 381/74, 26; 455/575.2

See application file for complete search history.

(56) References Cited

U.S. PATENT DOCUMENTS

| | | | | |
|---|---|---|---|---|
| 7,580,540 | B2 | 8/2009 | Zurek et al. | |
| 8,488,803 | B2 * | 7/2013 | Petit | H04R 3/04 381/71.8 |
| 8,861,745 | B2 | 10/2014 | Yen et al. | |
| 9,532,131 | B2 | 12/2016 | Dusan et al. | |
| 10,158,941 | B2 | 12/2018 | terMeulen | |
| 10,631,078 | B2 | 4/2020 | He | |
| 10,657,950 | B2 | 5/2020 | Hua et al. | |
| 10,714,073 | B1 | 7/2020 | Rui et al. | |
| 10,721,562 | B1 | 7/2020 | Rui et al. | |
| 11,302,298 | B2 * | 4/2022 | Liu | G01P 15/18 |
| 2006/0120540 | A1 * | 6/2006 | Luo | H04R 25/407 381/98 |
| 2013/0095924 | A1 | 4/2013 | Geisner et al. | |

(Continued)

FOREIGN PATENT DOCUMENTS

| | | | |
|---|---|---|---|
| CN | 109257675 | A | 1/2019 |
| CN | 109257675 | B | 12/2019 |

(Continued)

OTHER PUBLICATIONS

Extended European Search Report dated Aug. 12, 2022 issued in corresponding European Appln. No. 22163002.3.

(Continued)

*Primary Examiner* — Xu Mei

(74) *Attorney, Agent, or Firm* — Harness, Dickey & Pierce, P.L.C.

(57) ABSTRACT

A headset comprising a controller configured to receive wind information comprising information relating to a direction of wind in a predetermined coordinate system, direction information relating to a direction of the headset in the predetermined coordinate system, and an input audio signal and to generate an output audio signal based on the wind information, the direction information and the input audio signal.

20 Claims, 2 Drawing Sheets

(56) References Cited

U.S. PATENT DOCUMENTS

| | | | | |
|---|---|---|---|---|
| 2013/0204532 | A1* | 8/2013 | Nystrom | G01P 5/24 702/3 |
| 2019/0069074 | A1* | 2/2019 | Yamkovoy | G10K 11/17823 |
| 2019/0230433 | A1 | 7/2019 | Okuda | |

FOREIGN PATENT DOCUMENTS

| | | | |
|---|---|---|---|
| CN | 111405406 | A | 7/2020 |
| WO | WO-2016/011499 | A1 | 1/2016 |
| WO | WO-2019/023171 | A1 | 1/2019 |
| WO | WO-2020/225115 | A1 | 11/2020 |
| WO | WO-2020/254792 | A1 | 12/2020 |

OTHER PUBLICATIONS

Liu, D. et al. "Experiments on Deep Learning for Speech Denoising." Proc. Fifteenth Annual Conference of the International Speech Communication Association (2014).

Maas, A. et al. "Recurrent Neural Networks for Noise Reduction in Robust ASR." Proc. Interspeech (2012).

Michelsanti, D. et al. "An Overview of Deep-Learning-Based Audio-Visual Speech Enhancement and Separation." IEEE/ACM Transactions on Audio, Speech, and Language Processing, vol. 29 (2021).

Valin, J.M. "A Hybrid DSP/Deep Learning Approach to Real-Time Full-Band Speech Enhancement." 2018 IEEE 20th International Workshop on Multimedia Signal Processing (MMSP). IEEE (2018).

Valin, J.M. et al. "A Perceptually-Motivated Approach for Low-Complexity, Real-time Enhancement of Fullband Speech." Proc. Interspeech 2020; arXiv preprint arXiv:2008.04259 (2020).

Xia, Y. et al. "Weighted Speech Distortion Losses for Neural-Network-Based Real-Time Speech Enhancement." ICASSP 2020-2020 IEEE International Conference on Acoustics, Speech and Signal Processing (ICASSP). IEEE (2020).

* cited by examiner

HEADSET CAPABLE OF COMPENSATING FOR WIND NOISE

CROSS REFERENCE TO RELATED APPLICATIONS

This application claims priority to Danish Patent Application No. DK PA 2021 00277 filed on Mar. 18, 2021, the entire contents of which are incorporated herein by reference.

The present invention relates to a headset capable of compensating for wind noise and in particular which receives wind information and performs the compensation based on this information. Historically, wind noise compensation has been performed based on wind information derived on the spot, usually based on a microphone. Receiving the wind information from outside of the headset will reduce the processor load and thus the power consumption of the headset.

One purpose of noise suppression is to achieve speech enhancement by cleaning up a noisy incoming signal. The type of noise can vary but is usually background noise or wind noise. The use of speech enhancement is very typical in the "working-from-home" or "on-the-go" scenario, whereby the talker's noisy speech signal is enhanced before sending it to the other participants in the call.

A common technique for achieving noise suppression works by altering the signal in the frequency domain. Using a Short-time Fourier Transform (STFT) of the noisy signal, a model is used to predict a mask which can then be directly applied to the noisy signal to remove the noisy parts. The time-based waveform is then reconstructed using inverse FFT techniques, where the magnitude is obtained from the result of applying the mask, and the phase is simply copied directly from the input signal.

In recent years, deep learning techniques have become very popular due to the good performance of these algorithms in enhancing the signal. The purpose of the deep learning training algorithm is to determine the weights that will allow for the best possible mask to be predicted for a given input signal. Typically, deep learning noise suppression networks are trained in a supervised manner using a noisy speech mixture as input, and the corresponding clean signal as output—the learning task objective is then to obtain the network that best can obtain the clean speech signal from the noisy mixture.

However, usually, the only input in such a network is the noisy speech itself—the network does not concern itself with any additional information, such as metadata, that might explain interesting attributes of the noise signal itself. In such a setting, the algorithm relies exclusively on information from the signal. By adding such metadata to the input audio information and providing both audio and metadata as the input to the network, this allows the algorithm to utilize this metadata in making a more informed choice on how the speech enhancement algorithm should be carried out.

Former approaches within the headset category that exploit prediction of some of the wind characteristics are mainly based on a combination of mechanical approaches and wind parameters estimation based on microphone array processing. The former usually consists of a windshield and cavity designs that reduce the wind noise influence [WO2020EP62099A], typically, in the form of turbulence or resonances. In the latter, there exists several methods that estimate wind noise level and even wind direction and speed [U.S. Ser. No. 10/721,562, CN202010230792A, CN201811224424A, U.S. Ser. No. 16/159,371, and U.S. Pat. No. 8,861,745]. They later use this information to, for example, appropriately post-process the speech signal during a call, to calibrate the ANC system [U.S. Ser. No. 10/714,073 and U.S. Ser. No. 10/158,941], or to provide a more natural transparency mode [U.S. Ser. No. 10/657,950]. All three approaches have limitations in terms of the performance that they can technologically achieve, i.e., windshields cannot remove all the wind influence and microphone array processing techniques also present performance limitations with regard to how well wind noise characteristics can be predicted just based on microphone arrays. In particular, due to the small form factor of many headsets, the effectiveness of microphone array processing techniques is limited. In order to predict more accurately characteristics of the wind, there exists some work that include other sensor modalities beyond microphones. In particular, IMUs can be included to detect the headset motion relative to wind parameters estimation as estimated from meteorological institutes [WO2020GB51449A, U.S. Pat. Nos. 9,532,131, 7,580,540, WO2020GB51449A, and WO2019US23171A]. Some patents, still based on microphones and acoustics signals, present strategies to go one step beyond just wind noise parameters estimation and try to infer the situation which a user may be part of [Michelsanti, D., Tan, Z. H., Zhang, S. X., Xu, Y., YU, M., Yu, D., & Jensen, J. (2021). An overview of deep-learning-based audio-visual speech enhancement and separation. *IEEE/ACM Transactions on Audio, Speech, and Language Processing*].

A number of techniques already exist for dealing with wind noise. A mechanical shield made from cloth or synthetic fur is often utilized for outdoor microphones, but not practical for headsets and speaker phones due to form factor and also the manner in which identification of the users' speech may be compromised. Microphone beamforming can be fairly successful at attenuating noise from all directions apart from the mouth, but the limited spatial diversity available for a more directive beamformer on headsets makes this method limited. Several classical techniques from the signal processing domain exist to estimate and reduce background noise in general, and that enhance the speech signal. For example, both Wiener filters and background subtraction assume that both the speech signal and background noise are stationary (i.e. exhibiting non-varying statistics over time). However, the non-stationary nature of wind and speech makes these filters difficult to design and tune. This has in turn led to a surge in both non real-time [A. Maas, Q. V. Le, T. M. O'Neil, O. Vinyals, P. Nguyen, and A. Y. Ng, "Recurrent neural networks for noise reduction in robust ASR," in Proc. INTERSPEECH, 2012. and D. Liu, P. Smaragdis, and M. Kim, "Experiments on deep learning for speech denoising," in Proc. Fifteenth Annual Conference of the International Speech Communication Association, 2014] and real-time [Valin, Jean-Marc, et al. "A Perceptually-Motivated Approach for Low-Complexity, Real-Time Enhancement of Fullband Speech." arXiv preprint arXiv: 2008.04259 (2020) and Valin, Jean-Marc. "A hybrid DSP/deep learning approach to real-time full-band speech enhancement." 2018 IEEE 20th International Workshop on Multimedia Signal Processing (MMSP). IEEE, 2018.] deep learning techniques. Hybrid DNN/DSP techniques offer a lower-complexity solution as only the tuning parameters for the DSP system need to be estimated, resulting in a much smaller network. In general, the state-of-the-art has gone from passive techniques, to more active techniques.

In a first aspect, the invention relates to a headset comprising a controller, an information receiver, a direction sensor, and an input, wherein the controller is configured to:

receive, from the information receiver, wind information comprising information relating to a wind direction in a predetermined coordinate system, receive direction information from the direction sensor, the direction information relating to a direction of the headset in the predetermined coordinate system, receive, from the input, an input audio signal and generate an output audio signal, based on the wind information, the direction information and the input audio signal.

In this context, a headset may be any audio equipment which may be worn or carried by a person, such as an earbud, a hearable, headphone or the like. The headset may be configured to engage a single ear of a wearer, both ears of a wearer or no ears of a wearer. As will be described below, the headset may be used for providing audio to the wearer and/or deriving audio from the wearer.

The headset may be configured to engage a wearer's head, such as one or more ears. A head band or other retaining means may be provided for keeping the headset in place if desired.

The headset comprises an information receiver which is configured to receive wind information. The information receiver may receive the wind information from a wired or wireless connection. A wired connection may be a connection to a watch or mobile telephone of the wearer, from which the wind information may be received from an external source, such as an external server—usually via a wireless connection.

A wireless connection may be any type of wireless connection, such as GSM, Bluetooth, WiFi, Zigbee, LoRa or any other protocol or carrier. The wireless connection may be radio based or optical. The wireless connection may be to another piece of electronics, such as a mobile phone, a computer, a watch or the like of the wearer or may be to a local, regional or global network. If the information receiver is configured to receive the wind information from another piece of electronics of the wearer, that piece of electronics then usually would have means for communicating with the remote server or service often in the cloud.

The information receiver thus may be capable of, such as comprising suitable receiving elements, receiving this information on the protocol and the communication platform selected. The information receiver may also be used for transmitting data in the other direction, so that a single transceiver may be used for multiple purposes (see below).

The wind information comprises information relating to a wind direction in a predetermined coordinate system. The wind information may additionally comprise information relating to a wind speed. Also, wind predictions may have been made into the future so that the wind information may be provided with points in time or time intervals at or within which particular wind information is relevant. Thus, the wind information may comprise different wind information for different points in time or different time intervals. In addition, or alternatively, the wind information may comprise different wind information for different positions or different areas, catering for the headset to have relevant wind information if moving between the positions or areas. Naturally, the wind information may be provided for larger or smaller areas, so as to have different spatial resolution.

The headset comprises a direction sensor capable of generating or providing direction information. The direction information relates to a direction in the predetermined coordinate system. The direction may be relative to a particular portion of the headset or a predetermined direction thereof, such as a direction straight in front of a head of a user wearing the headset. The direction may be defined in relation to the direction sensor, such as by calibration.

The direction sensor may be based on any technology, such as GPS or, as is usually the preferred manner, an IMU (inertial measurement unit), which may be based on accelerometers, gyroscopes, magnetometers or the like. Often, the direction is determined in a horizontal plane. However, in certain embodiments will directions in a more vertical direction be of interest. When travelling in mountains, the wind direction may follow the plane or surface of the mountain and thus not be assumed horizontal. Thus, in some embodiments, the wind direction may relate to a direction unparallel to horizontal. The processor may receive wind information relating to the horizontal plane and may take into account if the headset is not moving in a horizontal plane or is in a position where the surface in general is not horizontal, such as when moving in mountains. The below position or headset direction sensor may be used for determining that the headset is present in a slanting environment, so that the wind information may be converted into wind direction and/or speed taking that into account. Even though a person wearing the headset stands on a slanting surface, the person will normally be standing up, so that the angle between the wind and the headset would differ from the situation with the same wind speed and direction in the horizontal plane but where the person was standing on a horizontal surface.

The direction sensor may provide an absolute direction output, such as if sensing the earth's magnetic field, or relative direction output, such as if based on an accelerometer or gyroscope, which may detect a direction and angle of turning of the sensor but not necessarily from which absolute direction this turning started from. Thus, the direction sensor may comprise additional sensors or may comprise a controller of its own for converting the direction sensor output data into absolute angles or directions if desired. Alternatively, the headset controller may perform such a conversion.

Different manners exist of calibrating a direction sensor. For example, if the wearer moves in a certain direction, that direction may be assumed to be the predominant direction also of the headset or direction sensor. Rotations around that direction may be expected, such as the turning of the head of a person walking or cycling, but the overall or mean direction would be that of the direction of movement of the person. Thus, the output of the direction sensor may be logged or determined, and a mean or predominant direction determined. This direction may then be used for calibrating the direction sensor based on a direction of movement when the person moves. A calibration of a direction sensor may be valid for a longer or shorter period of time depending on the type of direction sensor used.

The headset comprises an input from which an input audio signal may be received. In this context, the input audio signal may have any format and/or be based on any protocol, such as MP3, raw audio or the like. The input audio signal may be analog or digital, streamed, packet based, provided as a single file or the like. The input signal may represent audio intended for outputting from the headset as sound or sound detected by the headset and for transmission to a remote listener. Thus, the input may be configured to receive the input audio signal from a microphone, such as a microphone of the headset or a microphone provided in an element, such as a mobile phone, computer or watch, carried by or worn by the wearer. The input may be configured to receive the input audio signal from such element if desired.

When the input audio signal stems from a microphone, which would be usual if the wearer is engaged in a telephone call or voice/video conference, this audio is for use by a remote listener. Alternatively, the input audio signal is meant as a voice instruction to the headset or an external element with which the headset communicates.

Alternatively, the input may be configured to receive the input audio signal from an external source, such as in the situation of a voice/video call/conference or if the wearer is streaming music or audio from an external source, such as the cloud, a remote server or a computer/watch/mobile telephone from which the input audio signal is received.

Thus, the input may comprise a transmitter and/or receiver or may use the same transmitter/receiver as the information receiver, for receiving the input audio signal. Naturally, any such transmitter and/or receiver may be based on any desired technology, such as those described above and below.

The headset further comprises a controller. Naturally, the controller may be based on any technology, such as a processor, DSP, ASIC, FPGA, software controllable or hard-wired. The controller may be monolithic or may be formed by a number of elements in communication with each other. Naturally, the controller may have additional elements, such as storage, sensors, clocks and the like. The controller may be based on any type of AI, such as neural networks, or the like. Thus, the controller may be trained accordingly and suitably in order to be able to perform the intended function.

A power source may be provided, such as a battery, a fuel cell, solar panels, or other elements, such as elements deriving power from wireless signals, induction or the like. In addition, or alternatively, a cable may be provided for connecting the headset to a power source, such as a mains plug, a transformer, a battery, a cell phone or the like.

In one embodiment, the headset further comprises one or more microphones configured to feed microphone signals to the input. In this context, a microphone may be any type of sound sensor, and it may be based on any technology. Microphones are often used for capturing sound, often voice signals, speech or song, output by a wearer of the headset. Often, this sound/voice is collected in order to feed this to another unit, such as another headset, a telephone, a cell phone, a computer, a pad or the like, for a wearer of the other unit to hear the sound/voice. In this embodiment, the output of the microphone is used in the generation of the output audio signal, so that wind noise of that signal may be compensated for, reduced or the like.

In one embodiment, the headset further comprises a sound signal receiver configured to receive an audio signal and feed a received audio signal to the input. In this context, the sound signal receiver may be configured to receive the sound signal via any type of communication, wired or wireless, such as Bluetooth, NFC, WiFi, infrared communication, optical communication, Ethernet, FireWire, USB, Lightning or any other cabled communication type. In this situation, the received sound signal will be used for the generation of the output audio signal which may be used in a number of manners. In one situation, the output audio signal is provided to a wearer of the headset. In other situations, the received sound signal may be from another element, such as a cell phone in communication with the headset and which is not itself able to generate the output audio signal, where the output audio signal is then generated by the headset and output therefrom for another person, such as a person participating in a voice or video call—optionally again via the cell phone.

In one embodiment, the headset further comprises one or more loudspeakers configured to receive the output signal from the controller and to output corresponding sound. In this manner, the sound output from the loudspeaker(s) may be compensated for the wind noise or impact. In this context, a loudspeaker may be any type of element configured to receive a signal, such as an electrical signal (analog, digital or the like) and convert this into sound or generate a corresponding sound, where a corresponding sound may have sound frequencies corresponding to frequencies in the signals. Often, the headset will have a portion configured to be positioned in or at or directed at an ear canal of a person. Often, the loudspeaker(s) is/are provided in or at such portions and/or is/are provided and directed so as to feed sound into or toward the ear canal.

In one embodiment, the headset further comprises a sound signal transmitter configured to receive the output audio signal from the controller and transmit a corresponding sound signal. The sound signal transmitter may be based on any of the above protocols and communication types.

Naturally, the sound signal transmitter may be combined with other signal transmitters/receivers to form a single element configured to output the signals and optionally also receive the signals in question.

The sound signal transmitter may enable outputting of the generated output audio signal which may stem, cf. above, from sound generated by a wearer of the headset, such as is usual in a voice or video call.

In one embodiment, the head set further comprises a position sensor configured to output position information relating to a position of the headset in the predetermined coordinate system and forward the position information to the controller, the controller being configured to generate the output audio signal also based on the position information. A position sensor may be based on any desired technology, such as GPS, LTE, triangulation of GSM, WiFi signals or the like. Clearly, a position may be derived from other sources, such as social media posts, such as posts made within a sufficient small amount of time before the present time of day. A large number of technologies exist and are used, often in combination, for determining the position of e.g. cell phones.

The position output of the position sensor may be used in the controller to generate the output audio signal, especially if the wind information comprises wind information from a number of positions. In this manner, the controller may determine the most relevant wind information, such as by determining which of the positions represented in the wind information is the closest to the determined position. In addition, or alternatively, the positions represented in the wind information may relate also to different situations or parameters. Some positions may be positions relating to the presence in open terrain, some positions may relate to positions in urban surroundings, some positions may relate to an elevation of a certain number of meters and other positions may relate to the wind conditions at sea level. Then, the most relevant position of the wind information may relate more to the other parameters than a distance from the position of the wind information to the position of the headset.

The direction of the wind and the direction of the headset may be used in a number of manners. If the headset is on the lee side of a wearers head (the side away from that impacted by the wind), no compensation may be needed, or a different compensation may be needed compared to if the headset was on the wind side of the head.

This also means that if the headset comprises elements for engaging both ears of a person, the compensation for the two ears or elements may be different. This is especially relevant if a microphone is provided in one or both elements and/or if loudspeakers are present in both elements. In general, the impact of the wind may relate to a number of parameters, such as the actual wind speed of relevant portions of the headset. If the wind comes from a side of a user's head, part of the headset may be provided in the wind and part thereof may be provided on a side of the head where there is less wind or no wind. Then, the compensation determined for the two portions may differ. The impact of the wind on the headset thus may also take into account a presence of a head of a wearer of the headset.

From the direction of the wind in relation to the headset, such as determined from the wind direction and a direction and speed of any movement of the headset, as well as the direction of the headset, such as if the wearer turns his/her head, the direction and speed of the wind may be determined for predetermined portions of the headset, and the compensation may be based thereon. If the most relevant portion is a microphone or microphone opening, the position thereof may be the relevant portion used in the compensation. If the relevant portion is a housing enclosing an ear or a portion thereof, this may be used for the compensation.

Thus, in one embodiment, the headset comprises two elements each configured to engage with a separate ear of a wearer, and wherein the controller is configured to generate a separate output audio signal for each of the two elements. In this context, an element may be an earbud or a portion of an earphone having a headband interconnecting the two elements for engaging the two ears of the wearer.

In this context, the two elements may comprise loudspeakers where the signals for the individual loudspeakers are generated by the controller. As the two elements may experience different wind, the compensation for the two elements may be different.

If both elements comprise microphones, the microphones may experience different wind, so that the signals thereof are compensated differently in the controller.

In one embodiment, the wind information further comprises information relating to a wind speed, wherein the controller is configured to generate the output audio signal based also on the windspeed.

The windspeed may indicate an amount of noise or influence generated by the wind, so this information may be quite relevant.

In one embodiment, the headset further comprises a sensor for determining a speed of the headset and a direction of the speed of the headset in the predetermined coordinate system, and wherein the controller is configured to generate the output audio signal based also on the speed of the headset and the direction of the speed of the headset in the predetermined coordinate system.

The speed of the headset may alter the effective wind direction. Into this calculation may also the wind speed be brought so that an effective wind direction and speed may be calculated and used in the generation of the output audio signal.

It is noted that the speed of the headset need not be along the direction of the headset. If the headset is worn by a person cycling, the speed of the headset would be along the direction of cycling, but if the person turns his/her head to the left, the direction of the headset will change while its speed, and the direction of its speed, remains unaltered.

It is noted that different information may be received from other elements with which the headset communicates. Headsets are often connected to mobile phones, smart watches, computers, tablets and the like, which often have a host of sensors, the output of which may be used in the generation of the output audio signal. Thus, in one embodiment, the headset further comprises a receiver for:

receiving position information from an external element, such as from a phone, computer, tablet, or watch, configured to output position information relating to a position of the external element in the predetermined coordinate system and forwarding the position information to the controller, the controller being configured to generate the output audio signal also based on the position information.

In addition, or alternatively, the above-mentioned speed information (and speed direction information) may be received from the external element.

Again, the receiving of such information may be obtained using any type of communication channel, protocol and the like, and the receiver used may be combined with any other receivers/transmitters.

A second aspect of the invention relates to a method of operating a headset according to the first aspect of the invention, the method comprising:

a) the information receiver receiving the wind information, b) the direction sensor outputting the direction information, c) the input receiving the input audio signal and d) the controller receiving the wind information, the direction information and the input audio signal and generating the output audio signal, based on the wind information, the direction information and the input audio signal.

Naturally, any embodiments, situations, considerations, means, elements and methods mentioned above may be equally relevant in this context.

In one embodiment, step c) comprises receiving, as the input audio signal, a microphone signal output by one or more microphones of the headset. In this situation, the output of the microphone may now be used for generating the output audio signal, such as for use in a voice or video call.

In one embodiment, step c) comprises receiving the input audio signal from a sound signal receiver receiving an audio signal and feeding the received audio signal to the input. In this situation, the received audio signal, such as streaming audio, or audio from a voice/video call may now be compensated, such as before providing to a wearer of the headset.

In one embodiment, the method further comprises the step of feeding the output audio signal to one or more loudspeakers of the headset where the loudspeaker(s) output corresponding sound. Thus, the sound fed to a user of the headset may be compensated for the influence of the wind.

In one embodiment, the method further comprises the step of a sound signal transmitter receiving the output audio signal from the controller and transmitting a corresponding sound signal. Thus, the headset provides the output audio signal and feeds this to e.g. a receiver such as a participant in a voice/video call.

In one embodiment, the wind information further comprises information relating to a windspeed, and wherein step d) comprises generating the output audio signal also based on the windspeed. As described above, the windspeed may be relevant in the determination of the output audio signal.

In one embodiment, a speed sensor determines a speed of the headset and a direction of the speed of the headset in the predetermined coordinate system, and wherein step d) comprises the controller generating the output audio signal based also on the speed of the headset and the direction of the speed of the headset in the predetermined coordinate system. As mentioned above, also a direction of the speed of the headset may be determined, as this may differ from the direction of the headset, so that an overall relative wind direction and windspeed may be determined and used in the determination of the output audio signal.

As mentioned above, in one embodiment, the headset comprises two elements each configured to engage with a separate ear of a wearer, wherein step d) the comprises the controller generating a separate output audio signal for each of the two elements.

It is noted that the ability to suppress wind may depend on the user's or headset's direction of travel relative to the wind. When traveling into the wind, a different suppression strategy would be called into play to that when travelling in the same direction as the wind. Not only is the wind direction relative to the user's or headset's direction of travel of interest, but also the rate of change of direction of travel. Such a change might occur when turning, or in the occurrence of wind shear, where both the speed and direction of the wind relative to the user changes.

In one embodiment, a position sensor outputs position information relating to a position of the headset in the predetermined coordinate system and forwards the position information to the controller, where step d) comprises the controller generating the output audio signal also based on the position information. This may be relevant when the wind information comprises different wind information at different positions.

Clearly, the position sensor may also be used for determining the speed of the headset and optionally also the direction of the speed of the headset.

In one embodiment, the method further comprises the step of a receiver receiving position information from an external element outputting position information relating to a position of the external element in the predetermined coordinate system and forwarding the position information to the controller, where step d) comprises the controller generating the output audio signal also based on the position information. This is described above.

In general, the generation of the output audio signal may have many purposes. One purpose may be for improving a transparency feature of the headset. The transparency feature is one where the headset collects sound from the environment and feeds this (or parts of this) to the user wearing the headset. In this manner, the user need not remove the headset to hear sounds from the environment, such as cars, sirens, alarms, persons speaking to the person and the like. Often, such sound is collected by a microphone of the headset or of an element to which the headset is connected, such as a cell phone, watch or the like. It is noted, as is also indicated above, that different transparency may be determined or even wished for different ears of the person. The person may wish more transparency in an ear facing a street than an ear facing a building, for example. Also, different wind conditions at the two ears may result in different compensation performed for the ears.

The wind will have an impact on the sound collected by that microphone and thus will reduce the quality of the sound from the environment. Altering this sound will increase the quality and/or the intelligibility and thus make it easier for the wearer to know what is happening in the surroundings when using the transparency feature.

In another situation, the wind compensation is made in a signal received from a remote source, such as another person on a voice/video call and which is to be output by the headset. In this situation, the wind will create a sound at or in the headset, and the output audio signal may represent the intended audio signal with a cancelling component cancelling the wind noise generated.

In yet another situation, sound is collected by the headset in a windy situation, where the corresponding sound signal, often output by one or more microphones, is compensated or corrected before being fed to e.g. a receiver, such as a person on a voice/video call.

In the present context, such as where the user wears a set of earbuds, two instances of the noise suppression algorithm may be active, one for each ear. This additional data then comprises not only information about the direction and speed of the user relative to the wind direction, but also on which side of the head the algorithm is running (left vs right). Armed with both the audio signal and the before mentioned information, the controller, such as a neural network thereof, can now be trained to predict an appropriate mask (and hence suppression strategy) for a larger variety of signals in turn. The training scenario then boils down to creating a supervised dataset with input→output pairs, where the input is a given wind direction and location on the head, and the output is the corresponding clean speech signal. Given enough training data and model capacity, it is then, by means of standard training practices, possible to train a deep learning network to accommodate these different conditions. For example, if the meta data on wind indicates the wind is to the right of the user, this would indicate a more aggressive suppression strategy to be employed for the right earbud, and a less aggressive strategy for the left earbud. In this case, both the earbud designation (right) as well as the angle of the oncoming wind to the user's head is taken into consideration.

In addition to, or alternatively to, the AI approach, classical approaches may be used such as based on a combination of beamforming techniques and noise estimation as described above where the beam may be focused on an area of interest so as to suppress noise coming from that direction based on the wind noise predictions.

Another very simple approach is to e.g. provide different ANC pre-sets which could be assumed to be suitable for different wind conditions. In that situation, the most suitable pre-set may be determined based on the wind information. This same strategy could be used for transparency and during voice calls.

In the following, preferred embodiments of the invention are described with reference to the drawing, wherein.

Figure 1:
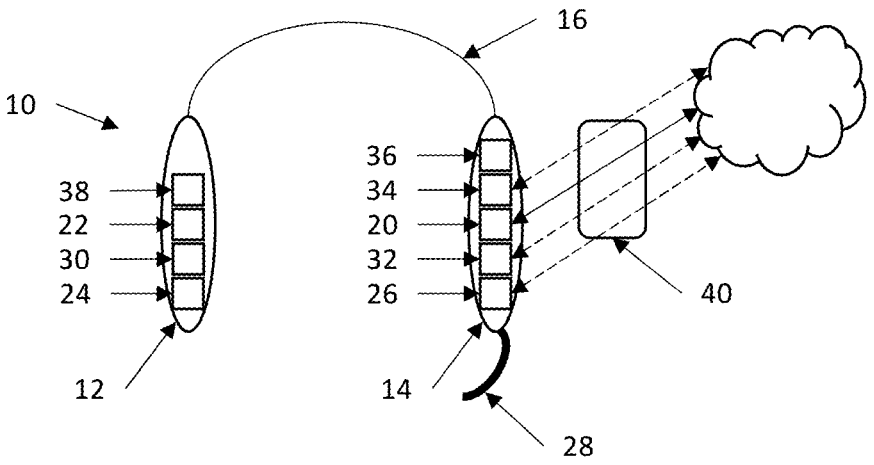
FIG. 1 illustrates a first headset according to the invention.
Figure 3:
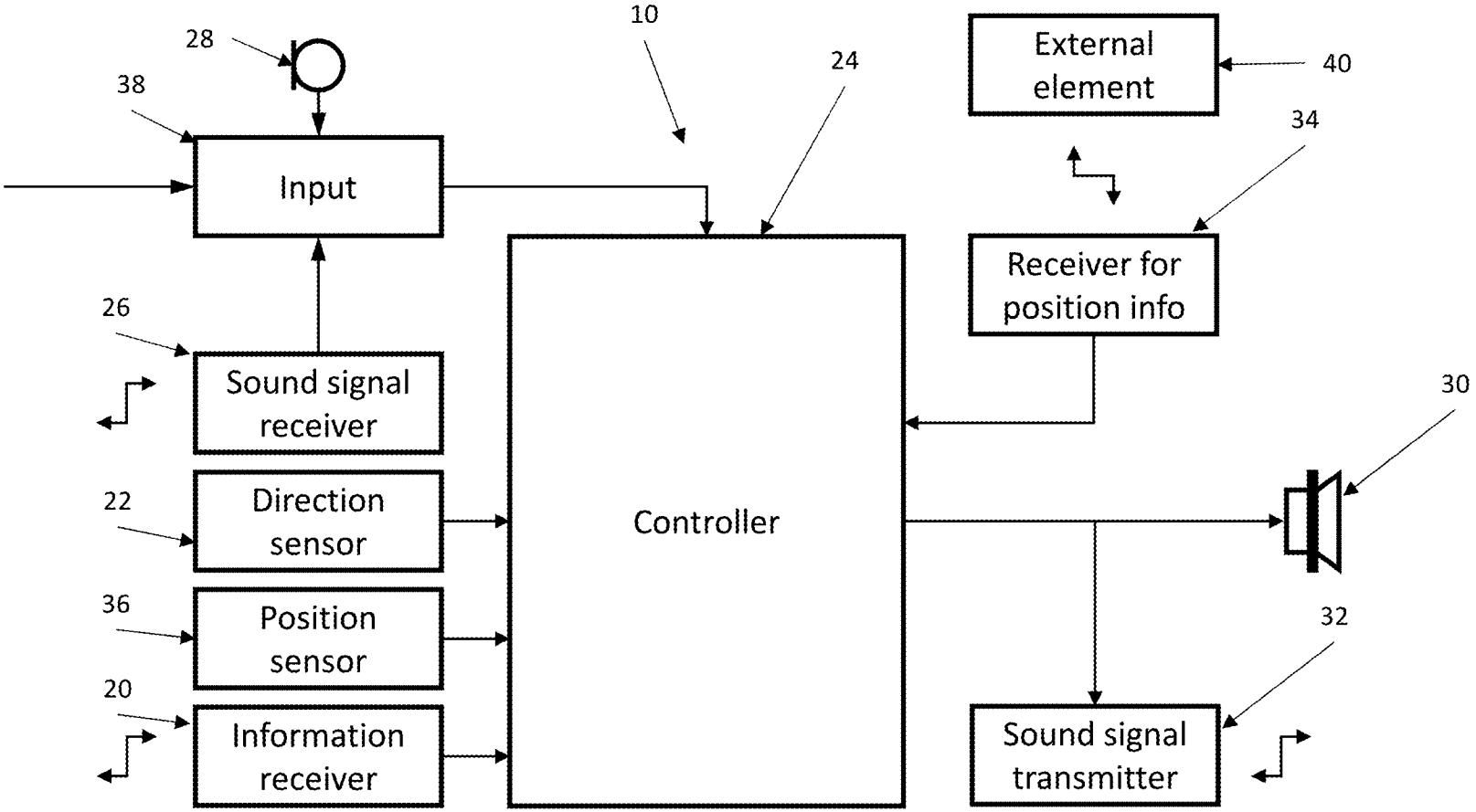
FIG. 3 illustrates a block diagram of electronic components of a preferred embodiment.

In FIG. 1, the headset 10 is a pair of headphones with two over-the-ear or on-the-ear portions 12/14 and a headband 16. FIG. 3 is a block diagram of some of the elements of FIG. 1.

The headset 10 may be used in a number of manners, such as providing sound to a user, receiving sound from a user or both.

As mentioned above, the influence of wind may vary greatly depending on the actual use of the headset 10 and the direction of the wind compared to a direction of the headset.

If the wind comes directly from the front, the influence thereof varies from a situation where the wind comes from the side.

For this reason, the headset 10 comprises an information receiver 20 configured to receive, such as via a wireless connection, wind information relating at least partly to a direction of wind and preferably in a predetermined coordinate system, such as in relation to South/North/East/West.

In addition, the headset 10 comprises a direction sensor 22 for providing direction information relating to the direction of the headset 10 in the same coordinate system.

A controller 24 receives the wind information from the information receiver 20 and the direction information from the direction sensor 22 as well as an input audio signal from an input 38 which may be received from an external source, such as the cloud, via an sound signal receiver 26, or which may stem from a microphone 28.

Also, a position sensor 36 may be provided or alternatively a receiver 34 for receiving position information, such as from the external element 40.

The controller 24 is configured to alter the received audio signal based on the wind information and the direction information. From this altering, an output audio signal is generated. This output audio signal may be fed to a loudspeaker 30 of the headset for providing to a wearer or may be fed to a sound signal transmitter 32 to a connection with a remote listener, such as during a voice call.

Thus, audio received from a remote source, such as a voice call or streaming music may be compensated for the wind influence before being converted into sound in the loudspeaker 30, or audio generated by the headset microphone 28 may be wind compensated before a corresponding audio signal is fed to a remote listener.

The wind information and optionally also the input audio signal and the output audio signal may be received from/transmitted to any resulting source or recipient via any type of communication elements such as a mobile phone 40. In fact, the external element, such as a phone, 40 may be used as a storage for such information, such as music files to be streamed to the headset 10 or stored wind information (see below). Also, as will be described below, the phone 40 may comprise additional sensors, the output of which may be used in the headset 10.

Thus, from the information received and generated, the wind direction and speed vis-à-vis the headset 10 may be determined.

As mentioned above, the simplest approach can be to already have a selection of presets/configuration parameters that have proven to work well in different wind situations (such as determined by a human expert) so that the controller 24 will select a suitable configuration based on the wind information. For example, 10 "wind" scenarios may be provided by an expert tonmeister as "optimal" filters so that whenever the wind information approximately matches one of the scenarios, the pertaining filter or compensation is selected. This can be for the ANC, transparency, or speech enhancement during a voice call.

Another approach is a more data-driven approach. For example, based on the wind information, the controller 24 acts to identify the parameters that maximize a users' satisfaction. A network could be designed for this purpose. The dataset can be built specifically for this purpose, i.e., an expert could assign ANC/transparency/call presets to "wind" scenarios. Alternatively, the user may be presented, at the same wind conditions, to different compensations between which the user will choose. Then, the network will learn that in a supervised way. The advantage of this approach is that the network will not choose from a discrete set of presets (as the classical approach described above), but it'll generate them "continuously".

Different portions of the headset 10 may be sensitive to the wind, such as microphones 28 or microphone openings. Thus, the wind speed and direction at such a microphone 28 may be determined. This may depend on its position on the headset 10 and thus on the direction of the wind vis-à-vis the direction of the headset 10.

Also other situations exist where the wind impact is desired compensated for, such as when sound is generated by a loudspeaker 30, where the sound generated by the wind may be undesired. In this situation, the relevant position or portion of the headset 10 could be a housing comprising the loudspeaker 30 and/or covering an ear or ear canal to which the loudspeaker 30 feeds sound. Then, the wind impact at or on this housing may be determined from the wind speed and direction.

Naturally, a head of a wearer may be taken into account in the determination of the wind direction and speed, as a direction toward one side of a head would bring one ear into the wind and the other out of the wind. This may be determined from the direction of the headset 10 and from predetermined knowledge of the effect of a head of a wearer.

Naturally, not only the wind direction may be of interest. Also, the wind speed may be used in the compensation, as it may have a large influence on the wind noise.

It is noted that as wind directions may not vary with high frequencies and may be predicted, it may be sufficient, also from a bandwidth point of view, to download e.g., a present wind direction and future wind directions, such as information as to when in the future which wind direction is foreseen. Then, wind information may not be required or desired updated continuously but may be downloaded intermittently or when the downloaded wind information has expired. Alternatively, a quality of the compensation may be monitored, and when the compensation quality drops below a predetermined threshold, the wind information may be seen as insufficiently precise, and updated information may be downloaded, or a download frequency may be increased.

Naturally, it may alternatively be desired to receive updated wind information in real time, such as if the position of the headset changes. It is known that wind directions, such as in cities, may vary even within the distance of 100 meters.

In different situations, it is desired to know also the position of the headset 10. As described above, the wind direction may vary from position to position so that the position of the headset 10 may be determined in order to arrive at a more realistic wind direction at the headset 10. The position may be determined by the position sensor 36, an additional sensor in the headset 10 or a sensor otherwise connected to the listener, such as a mobile phone 40, a GPS watch or the like worn by the listener.

This may be obtained by forwarding the headset position to a remote location to receive tailored wind information. Alternatively, more generic wind information relating to multiple positions may be received and the relevant wind direction derived therefrom by the position.

The knowledge of the position of the headset 10 also may bring about another advantage. From consecutive positions, a velocity of the headset 10 may be determined, as well as a direction of the movement of the headset 10. From this, an actual wind direction may be determined and used in the compensation.

The direction of movement of the headset 10 may be different from the direction of the headset 10. If the listener is riding a bicycle, the direction of movement of the headset 10 will be the direction of movement of the bicycle. If the listener is looking straight ahead, the direction of the headset 10 will be in the same direction, but when the listener looks to the left, the direction of the headset 10 will change, while the direction of movement of the headset 10 will remain the same.

Clearly, from the quality of the compensation (which is based on an expected wind direction), it may be estimated how well the expected wind direction corresponds to an actual wind direction. If the correspondence is high, the compensation quality would be high. This correspondence may be uploaded to e.g. a central server together with the expected wind direction and a position of the headset 10. In this manner, updated or improved wind information may be generated and fed to headsets in the same area.

Naturally, the signal compensation may be turned off in situations where the wind direction or speed changes abruptly, where the wind speed drops below a threshold, if the compensation to be performed drops below a threshold or e.g. if the person moves at a too high speed (and e.g. sits in a car).

Figure 2:
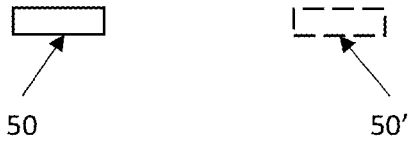
FIG. 2 illustrates a second headset according to the invention.

FIG. 2 illustrates one or two earbuds 50 and 50' each having a portion for introduction to or into an ear canal of the listener. These earbuds may comprise the same elements as the headphone of FIG. 1. A single earbud 50 may actually suffice if having all the elements in question.

The invention claimed is:

1. A headset comprising a controller, an information receiver, a direction sensor, and an input, wherein the controller is configured to:

receive, from the information receiver, wind information comprising information relating to a wind direction in a predetermined coordinate system, receive direction information from the direction sensor, the direction information relating to a direction of the headset in the predetermined coordinate system, receive, from the input, an input audio signal and generate an output audio signal, based on the wind direction, the direction information and the input audio signal.

2. A headset according to claim 1, further comprising one or more microphones configured to feed microphone signals to the input.

3. A headset according to claim 1, further comprising a sound signal receiver configured to receive an audio signal and feed the received audio signal to the input.

4. A headset according to claim 1, further comprising one or more loudspeakers configured to receive the output audio signal from the controller and to output corresponding sound.

5. A headset according to claim 1, further comprising a sound signal transmitter configured to receive the output audio signal from the controller and transmit a corresponding sound signal.

6. A headset according to claim 1, further comprising a position sensor configured to output position information relating to a position of the headset in the predetermined coordinate system and forward the position information to the controller, the controller being configured to generate the output audio signal also based on the position information.

7. A headset according to claim 1, wherein the wind information further comprises information relating to a wind speed, and wherein the controller is configured to generate the output audio signal based also on the wind speed.

8. A headset according to claim 1, wherein the headset comprises two elements each configured to engage with a separate ear of a wearer, and wherein the controller is configured to generate a separate output audio signal for each of the two elements.

9. A headset according to claim 1, further comprising a sensor for determining a speed of the headset and a direction of the speed of the headset in the predetermined coordinate system, and wherein the controller is configured to generate the output audio signal based also on the speed of the headset and the direction of the speed of the headset in the predetermined coordinate system.

10. A headset according to claim 1, further comprising a receiver for:

receiving position information from an external element configured to output position information relating to a position of the external element in the predetermined coordinate system and forwarding the position information to the controller, the controller being configured to generate the output audio signal also based on the position information.

11. A method of operating a headset according to claim 1, the method comprising:

a) the information receiver receiving the wind information, b) the direction sensor outputting the direction information, c) the input receiving the input audio signal and d) the controller receiving the wind information, the direction information and the input audio signal and generating the output audio signal, based on the wind information, the direction information and the input audio signal.

12. A method according to claim 11, wherein step c) comprises receiving, as the input audio signal, a microphone signal output by one or more microphones of the headset.

13. A method according to claim 11, wherein step c) comprises receiving the input audio signal from a sound signal receiver receiving an audio signal and feeding the received audio signal to the input.

14. A method according to claim 11, further comprising the step of feeding the output audio signal to one or more loudspeakers of the headset where the loudspeaker(s) output corresponding sound.

15. A method according to claim 11, further comprising the step of a sound signal transmitter receiving the output audio signal from the controller and transmitting a corresponding sound signal.

16. A method according to claim 11, wherein the wind information further comprises information relating to a wind speed, and wherein step d) comprises the controller generating the output audio signal based also on the wind speed.

17. A method according to claim 11, wherein the headset comprises two elements each configured to engage with a separate ear of a wearer, and wherein step d) comprises the controller generating a separate output audio signal for each of the two elements.

18. A method according to claim 11, wherein a speed sensor determines a speed of the headset and a direction of the speed of the headset in the predetermined coordinate system, and wherein step d) comprises the controller generating the output audio signals based also on the speed of the headset and the direction of the speed of the headset in the predetermined coordinate system.

19. A method according to claim 11, wherein a position sensor outputs position information relating to a position of the headset in the predetermined coordinate system and forwarding the position information to the controller, where step d) comprises the controller generating the output audio signal also based on the position information.

20. A method according to claim 11, further comprising the step of a receiver receiving position information from an external element outputting position information relating to a position of the external element in the predetermined coordinate system and forwarding the position information to the controller, where step d) comprises the controller generating the output audio signal also based on the position information.

* * * * *